US008784607B2

(12) United States Patent
Schoenhaber et al.

(10) Patent No.: US 8,784,607 B2
(45) Date of Patent: Jul. 22, 2014

(54) PROCESS FOR THE PRODUCTION OF BLEACHED WOOD PARTICLES AND PALE TO WHITE WOOD-BASE MATERIALS

(75) Inventors: Dieter Schoenhaber, Meckenheim (DE); Stefan Erren, Kallstadt (DE); Katerina Stieglitz, Mannheim (DE); Eberhard Beckmann, Neustadt (DE); Andres Carlos Garcia Espino, Mannheim (DE); Norbert Jaeger, Worms (DE); Juliane Kruesemann, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 189 days.

(21) Appl. No.: 12/597,402

(22) PCT Filed: Apr. 23, 2008

(86) PCT No.: PCT/EP2008/054879

§ 371 (c)(1), (2), (4) Date: Oct. 23, 2009

(87) PCT Pub. No.: WO2008/129048

PCT Pub. Date: Oct. 30, 2008

(65) Prior Publication Data

US 2010/0132898 A1 Jun. 3, 2010

(30) Foreign Application Priority Data

Apr. 24, 2007 (EP) ..... 07106804

(51) Int. Cl.
*D21C 9/10* (2006.01)
*D21J 1/00* (2006.01)

(52) U.S. Cl.
CPC ..... *D21C 9/1089* (2013.01); *D21C 9/1084* (2013.01); *D21J 1/00* (2013.01)
USPC ..... 162/16; 162/218; 428/292.4

(58) Field of Classification Search
CPC ..... D21C 9/1084; D21C 9/1089; D21J 1/00
USPC ..... 162/26, 218; 428/292.4
See application file for complete search history.

(56) References Cited

U.S. PATENT DOCUMENTS

| | | | | |
|---|---|---|---|---|
| 3,467,574 | A | 9/1969 | West | |
| 3,653,804 | A * | 4/1972 | Janson et al. | 8/110 |
| 3,669,895 | A * | 6/1972 | Shastri | 252/186.25 |
| 4,357,256 | A * | 11/1982 | Yamaguchi | 252/188.24 |
| 5,129,987 | A | 7/1992 | Joachimides et al. | |
| 5,298,118 | A * | 3/1994 | Devic | 162/26 |
| 5,607,547 | A | 3/1997 | Nye et al. | |
| 2002/0042353 | A1 * | 4/2002 | Berghofer et al. | 510/302 |
| 2007/0256804 | A1 | 11/2007 | Garcis Espino et al. | |

FOREIGN PATENT DOCUMENTS

| | | |
|---|---|---|
| EP | 0 333 398 | 9/1989 |
| EP | 0 604 088 | 6/1994 |
| WO | 2004 035276 | 4/2004 |
| WO | 2006 042651 | 4/2006 |
| WO | 2007 000418 | 1/2007 |

OTHER PUBLICATIONS

Lewis, Robert, CRC dictionary of agricultural sciences, 2002, CRC Press LLC, p. 204.*

* cited by examiner

*Primary Examiner* — Anthony Calandra
(74) *Attorney, Agent, or Firm* — Oblon, Spivak, McClelland, Maier & Neustadt, L.L.P.

(57) ABSTRACT

The present invention relates to a process for the production of bleached wood particles and a process for the production of pale to white wood-base materials which are produced from the bleached wood particles.

10 Claims, No Drawings

PROCESS FOR THE PRODUCTION OF BLEACHED WOOD PARTICLES AND PALE TO WHITE WOOD-BASE MATERIALS

The present invention relates to a process for the production of bleached wood particles and a process for the production of pale to white wood-base materials which are produced from the bleached wood particles.

In the area of wood-base materials, the market in so-called medium density fiberboards (MDF boards) and high density fiberboards (HDF boards) is growing sharply. The production quantities have more than tripled in the last ten years.

MDF and HDF boards can be processed like conventional particle boards. Owing to their uniform structure, however, they are also suitable for the production of profiled parts and are increasingly becoming established in furniture construction. Thus, for example, furnishing articles for rooms and for decorative purposes (for example in trade fair construction) but also higher-quality furniture are manufactured from these boards and then, in order to keep the wood-like structure visible, are only provided with a colorless coat or are laminated with overlay.

Of course, depending on the type of wood used, these boards have a more or less distinct brown color which is only of little esthetic value for use in the furniture sector.

By beta dying with the colorant preparations disclosed in WO-A 04/35276 and comprising pigment and dye, the natural color of the wood fibers can be compensated. In this way, it is possible to obtain colored, completely dyed, lightfast and hence esthetically high-quality MDF boards which are suitable for the production of long-lasting articles, for example of furniture for the living area.

For the production of pieces of furniture and interior decoration objects, for example for kitchen or bathroom, pale or even white wood-base materials, in particular wood-base material boards, are of particular interest.

WO 2006/042651 describes pale to white wood-base material boards whose pale natural color is achieved by the use of bleached wood fibers and, if appropriate, the addition of white pigment and/or of an optical brightener. In the chemical bleaching, the color-imparting ingredients of the wood particles are destroyed or rendered ineffective by oxidizing and/or reducing chemicals. The wood fibers are usually bleached in bleaching towers during countercurrent flow or in the preheater or in the digester during the processing of the woodchips usually used as raw material. The plastified woodchips are subsequently defibrated in the refiner and the fibers are removed from the refiner by the so-called blowline. Both oxidizing substances, such as hydrogen peroxide and salts of inorganic and organic peracids (for example percarbonate) and reducing substances, such as sulfinic acids, sulfites and dithionites, are used as bleaches.

The bleaching of the wood fibers in bleaching towers is an additional process step in the production thereof, which increases the cost of the apparatus. It is therefore expedient to transfer the bleaching of the wood fibers to the process for their production, as described in WO 2006/042651 A1. However, the bleaches must be carefully chosen since bleaches introduced into the process and their reaction and degradation products can then remain on the wood fibers and in the product steps produced therefrom. In order to use an existing plant for the production of wood fibers, the bleaches must be particularly suitable and they must have corresponding stabilities, redox potentials and reaction times. In addition, they should not undergo disadvantageous subsequent reactions.

Thus, for example, hydrogen peroxide is unsuitable as a bleach since it is necessary to work in an alkaline medium which leads to swelling of the wood fibers and subsequent yellowing, which is undesired in the end products. Oxygen and ozone are used in the bleaching of pulp but the bleaching of lignin-containing wood requires long reaction times. Sulfites and many organic bleaches have redox potentials which are too low under the specified conditions and are therefore too weak as bleaches in this case. On the other hand, sodium dithionite is highly reactive but decomposes at temperatures above from 80 to 100° C. The degradation products which result and remain in the wood fibers are, for example, hydrogen sulfide and thiosulfate, which are noticeable in the end product as an unpleasant odor.

An object of the present invention is therefore an alternative process for the production of bleached wood particles in which neither undesired nor disadvantageous compounds originating from the bleach remain behind on or in the wood particles, with which a good bleaching effect is achieved and which can be integrated without high cost of apparatus into existing processes for the production of wood fibers.

The object is achieved by a process for the production of bleached wood particles comprising the steps a) milling of optionally pretreated comminuted, cellulose-containing raw materials in a refiner to give wood particles and b) removal of the wood particles from the refiner, the wood particles being bleached in step a) or in step b) by addition of a bleach composition comprising at least one bleach selected from the group consisting of sulfinic acid and its salts, stabilized hydrosulfites, stabilized sulfites and stabilized dithionites.

In a preferred embodiment, the wood particles are removed via a blowline in step b).

In a likewise preferred embodiment, the comminuted, cellulose-containing raw materials are pretreated in a digester before they are used in step a) of the process according to the invention.

Furthermore, a process for the production of pale to white wood-base materials was found, which comprises the following steps:

a) milling of optionally pretreated comminuted, cellulose-containing raw materials in a refiner to give wood particles, b) removal of the wood particles from the refiner and c) processing of the bleached wood particles to give pale to white wood-base materials, the wood particles being bleached in step a) or in step b) by addition of a bleach composition comprising at least one bleach selected from the group consisting of sulfinic acid and its salts, stabilized hydrosulfites, stabilized sulfites and stabilized dithionites.

In a preferred embodiment, the wood particles are removed via a blow line in step b).

In a likewise preferred embodiment, the comminuted, cellulose-containing raw materials are pretreated in a digester before they are used of the process in step a) according to the invention.

The process according to the invention for the production of bleached wood particles can be integrated into existing processes for the production of wood particles without high cost of apparatus. The bleach compositions to be used according to the invention have the major advantage that they are not prematurely degraded in the refiner or in the blowline and, in spite of the very short to short residence times of the wood particles, which are in the region of milliseconds in the refiner and the region of minutes in the blowline, display a very good to good bleaching effect without leaving behind disadvantageous or even harmful compounds on or in the wood particles.

If the same raw material is used for the wood particles, the wood-base materials produced by the process according to the invention surprisingly have a greater lightness in comparison with the wood-base materials which were produced from wood particles bleached in the digester or preheater.

Particularly advantageous is the production of the wood-base materials directly after the production according to the invention of the bleached wood particles since pale to white wood-base materials are obtained here without further cost of apparatus.

In the context of the present invention, "wood particles" are understood as meaning small, cellulose-containing particles. These include, for example, fibers and chips of wood and other cellulose-containing materials. In principle, all fibrous materials obtainable from plants can serve as base material for the wood particles and wood-base materials according to the invention. Thus, wood is usually used as raw material but suitable cellulose-containing particles can also be obtained from palms and from annual plants such as begasse or straw. Agricultural waste products constitute a further source. Preferred base materials are pale wood types, in particular spruce or pine, but darker wood types, such as beech or eucalyptus, can also be used.

The cellulose-containing raw materials are first comminuted and, if appropriate, washed. If appropriate, a pretreatment can then follow. Wood is, for example, first finely chopped and washed and the water-moist wood pieces (chips) are first preheated.

In a preferred embodiment of the process according to the invention, the comminuted, cellulose-containing raw materials are pretreated in a so-called digester. Usually, this is carried out at a pressure of from 2 to 5 bar and a temperature of from 100 to 180° C. The exact temperatures and pressures depend on the raw materials used in each case. For the digestion of annual plants, lower temperatures than in the digestion of perennial plants, such as wood, are usually sufficient.

In step a), the optionally pretreated, comminuted, cellulose-containing raw materials are transferred to a so-called refiner and milled there to give wood particles. A refiner is usually a milling unit having rotating and, if appropriate, stationary knives/discs for milling fibers and preferably consists of two metal discs which are provided with radial relief and are present close to one another. Of these two discs, one disc can move but it is also possible for both discs to rotate in opposite directions. Usually, superatmospheric pressure is employed in the refiner. The milling of the optionally pretreated, comminuted cellulose-containing raw materials can also be carried out in other apparatuses suitable for this purpose.

In step b), the wood particles are removed from the refiner. In a preferred embodiment of the present invention, the wood particles are blown out of the refiner through a so-called blowline. A blowline is usually understood as meaning a blowpipe through which the wood particles are removed by the superatmospheric pressure prevailing in the refiner.

According to the invention, the wood particles are bleached in the refiner or during removal of the wood particles from the refiner by addition of a bleach composition comprising at least one bleach. If, according to a preferred embodiment, the wood particles are removed via a blowline, the addition of the bleach composition can take place in the refiner or in the blowline.

According to the invention, the wood particles are reductively bleached. For example, reducing sulfur compounds, such as dithionites, disulfites, sulfites or sulfur dioxide, sulfinic acids and salts thereof, in particular the alkali metal salts and especially the sodium salts, and hydroxycarboxylic acids, such as citric acid and malic acid, are suitable for the reductive bleaching. According to the present invention, bleach compositions which comprise at least one bleach selected from the group consisting of the stabilized dithionites, the stabilized hydrosulfites, the stabilized sulfites and the sulfinic acids and salts thereof are used. Stabilized hydrosulfites and stabilized sulfites and sulfinic acids and salts thereof are preferably used as bleaches, hydroxymethylsulfinic acid being preferred as sulfinic acid.

The stabilization of the dithionites, sulfites and hydrosulfites is effected by the addition of basic salts.

In addition to the at least one bleach and, if appropriate, stabilizers thereof, the bleach composition may also comprise further assistants, such as complexing agents, for example EDTA or polyphosphates.

According to the invention, the wood particles are preferably bleached by means of the bleach composition mentioned below. The bleach composition according to the invention comprises a) from 60 to 95% by weight of one or more hydrosulfite salts
b) from 1 to 25% by weight of one or more sulfite salts
c) from 1 to 10% by weight of one or more basic salts
d) from 0 to 10% by weight of one or more tripolyphosphate salts.

Hydrosulfite salts used may be the alkali metal salts; sodium and potassium hydrosulfite are preferred and sodium hydrosulfite is particularly preferred.

Sulfite salts which may be used are the alkali metal salts; sodium and potassium sulfite are preferred and sodium sulfite is particularly preferred.

The basic salts may be selected from the group consisting of the carbonates and bicarbonates; the alkali metal carbonates are preferred and sodium carbonate is particularly preferred.

Tripolyphosphate salts which may be used are potassium and sodium tripolyphosphate, and sodium tripolyphosphate is preferred.

According to the present invention, the bleach composition is added to the cellulose-containing raw material or to the wood particles during the production thereof. The addition is effected in the refiner or during removal of the wood particles. According to a preferred embodiment, the wood particles are removed via a blowline; according to the invention, the bleach composition comprising at least one bleach is added in this embodiment in the refiner or in the blowline, preferably in the refiner or at the beginning of the blowline, particularly preferably in the refiner.

The bleach composition is metered so that the amount of bleach is from 0.1 to 6% by weight, preferably from 0.5 to 5% by weight and particularly preferably from 1 to 3% by weight per absolutely dry fibers.

The bleach compositions are added to the wood particles in the refiner or in the blowline usually in the form of aqueous solutions, the concentration of bleach composition in the aqueous solution ranging from 1 to 25% by weight, preferably from 5 to 20% by weight and particularly preferably from 10 to 15% by weight.

The bleached wood particles can be further processed directly; they can also be dried and further processed in the dried state. Furthermore, the dried wood particles can be temporarily stored before the further processing. A preferred possibility for further processing of the bleached wood particles is the production of wood-base materials, in particular directly after the bleaching step.

The present invention furthermore relates to a process for the production of pale to white wood-base materials, which comprises the following steps:

a) milling of the pretreated comminuted, cellulose-containing raw materials in a refiner to give wood particles, b) removal of the wood particles from the refiner and c) processing of the bleached wood particles to give pale to white wood-base materials, The wood particles being bleached in step a) or in step b) by addition of a bleach composition comprising at least one bleach selected from the group consisting of sulfinic acid and its salts, stabilized hydrosulfites, stabilized sulfites and stabilized dithionites.

According to the invention the wood particles are preferably bleached in step a) or b) with the bleach composition mentioned below:

a) from 60 to 95% by weight of one or more hydrosulfite salts b) from 1 to 25% by weight of one or more sulfite salts c) from 1 to 10% by weight of one or more basic salts d) from 0 to 10% by weight of one or more tripolyphosphate salts.

In a preferred embodiment for the production of pale to white wood-base materials, the wood particles are removed in step b) via a blowline.

In a likewise preferred embodiment, the comminuted, cellulose-containing raw materials are pretreated in a digester before they are used in step a) of the process according to the invention.

The wood-base materials produced according to the invention may be MDF boards, HDF boards, particle boards or OSB boards. MDF boards and HDF boards are preferred and MDF boards are particularly preferred.

MDF boards, HDF boards, OSB boards and particle boards are also referred to as wood-base material boards. They are preferably produced by a procedure in which fibers or chips coated with glue are poured to give mats, if appropriate precompacted while cold and pressed in heated presses at temperatures of from 170 to 240° C. to give boards.

According to the present invention, the binder used as glue usually comprises urea/formaldehyde resins, which in some cases are reinforced with melamine, and urea/melamine/formaldehyde resins, melamine/formaldehyde resins, phenol/melamine resins and phenol/formaldehyde resins. Isocyanates are used as further binders and are usually based on polymethylene diisocyanate.

According to the invention, the wood particles can be coated with glue directly, i.e. while still moist, in the blowline. However, the previously dried wood particles can also be coated with glue in mixers, preferably continuously operating mixers. Coating with glue in mixers is preferred in particular in the production of particle boards and OSB boards; for the production of HDF boards and MDF boards, the coating with glue preferably takes place in the blowline. A further possible process for coating with glue consists in so-called dry glue coating, where the dried wood particles are sprayed with glue.

If the wood particles are coated with glue in the blowline, they subsequently pass through a dryer in which they are dried to moisture contents of from 8 to 15% by weight. The glue-coated and, if appropriate, dried wood particles are then poured to give mats, if appropriate precompacted while cold and pressed in heated presses at temperatures of from 170 to 240° C. to give boards.

In a particularly preferred embodiment of the present invention, the further processing of the bleached wood particles takes place directly after the bleaching. After the bleaching according to the invention by addition of a bleach composition in the refiner or at the beginning of the blowline, the bleached wood particles are coated with glue in the blowline, then dried in a dryer to a residual moisture content of from 8 to 15% by weight and further processed to give wood-base materials.

In a further preferred embodiment of the process according to the invention for the production of pale to white wood-base materials, at least one white pigment is added to the wood particles during the production process. Beta dying of the resulting wood-base material results therefrom.

According to the invention, the term "white pigment" comprises both inorganic pigments, such as titanium dioxide (rutile, C.I. Pigment White 6), calcium carbonate and mixed calcium/magnesium carbonates (e.g. dolomite), zinc oxide, zinc sulfite, lithopone and sodium aluminum silicates, as well as strongly light-scattering plastics emulsions and dispersions which impart whiteness. The inorganic white pigments are preferred and titanium dioxide is particularly preferred. It is also possible to use mixtures of white pigments.

The white pigments are preferably used in the form of aqueous dispersions in which they are present in finely divided form since they can in this form be introduced via the blow line, separated from or together with the glue, directly into the production process for the wood-base materials. These pigment dispersions may comprise further conventional assistants, in particular wetting agents and dispersants, antifoams and biocides, antisettling agents, water retention agents and rheology modifiers, and are preferably prepared by wet milling of all components, for example in a stirred ball mill.

Recommended concentrations of the white pigment in the prepared wood-base material are as a rule from 0.5 to 15%, preferably from 1 to 6% per absolutely dry wood fiber.

A further increase in the whiteness can be achieved by adding optical brighteners which, owing to their bluish fluorescence (complementary color), compensate graying and yellowing.

In principle, all blue-emitting fluorescent dyes, particularly commercially available products, e.g. Ultraphor® (BASF), Leucophor® (Clariant) or Tinopal® (Ciba), from the chemical classes of substances comprising stilbenes, distyrylbiphenyls, coumarins, naphthalimides, and benzoxazole and benzimidazole systems linked via double bonds are suitable.

The optical brighteners may be introduced into the production process for the wood-base materials in the form of aqueous dispersions or solutions, separately from or together with the glue.

If an optical brightener is used, its concentration in the prepared wood-base material is in general from 0.01 to 1%, preferably from 0.08 to 0.2% per absolutely dry wood fiber.

Those wood-base materials according to the invention in which both at least one white pigment and at least one optical brightener are combined are very particularly preferred since the individual contributions are enhanced by synergistic effects to give maximum overall whiteness.

With respect to the process, it is particularly advantageous to prepare the white pigments and the optical brighteners together in a single aqueous dispersion, which is added to the glue liquor before this is injected through the blowline into the production process for the wood-base material.

Any changes in the physical properties of the pressed wood-base material boards which result from the measures according to the invention can be controlled by the choice of the glue quality and amount of glue. The choice of the corresponding parameters is familiar to the person skilled in the art.

The present invention furthermore relates to bleached wood particles which can be produced by the process according to the invention for the production of bleached wood particles.

The present invention further relates to pale to white wood-base materials which can be produced by one of the above-described processes according to the invention.

The present invention is explained with reference to the production of MDF boards.

The MDF production process is, as is customary, carried out with a throughput of from 28 to 30 kg/h, the chips are defibrated by the refiner, and the fibers obtained are discharged through the blowline and continuously coated in the blowline with the glue batch mentioned in each case in the examples.

The glue-coated wood fibers are dried in the subsequent continuous dryer to a residual moisture content of about 9% by weight and then poured batchwise to give a mat, precompacted while cold and pressed at 190° C. with a press time factor of 15 s/2 mm to give a 16 mm-thick board.

COMPARATIVE EXAMPLE C1

Not According to the Invention

Spruce woodchips were used as cellulose-containing raw material. The fibers were defibrated without addition of a bleach composition and were continuously coated in the blowline with glue batch mentioned in Table 1.

TABLE 1

| Glue batch | |
|---|---|
| Urea/melamine/formaldehyde resin, 66.5% strength by weight in water | 100.0 parts by weight |
| Paraffin dispersion, 60% strength by weight in water | 4.0 parts by weight |
| Water | 33.8 parts by weight |
| Solid resin content of the liquor | 48% |
| Solid resin/absolutely dry fibers | 14% |
| Liquor per 100 kg of absolutely dry fibers | 29.2 kg |

COMPARATIVE EXAMPLE C2

Not According to the Invention

A 15% strength by weight aqueous hydrosulfite solution, corresponding to 5% by weight of bleach per absolutely dry fibers, is added to spruce woodchips during the MDF production process in the refiner. In the blowline, the fibers are coated with the glue batch mentioned in Table 1.

The whiteness achieved (expressed by the lightness difference ΔL), based on comparative example C1 as standard, is shown in Table 2.

TABLE 2

| Example | ΔL |
|---|---|
| C2 | 1.9 |
| C1 | — |

EXAMPLE 1

According to the Invention

A 15% strength by weight aqueous solution of the bleach compositions 1a to 1c mentioned in Table 3, corresponding to 5% by weight of bleach per absolutely dry fibers, is added to spruce woodchips during the MDF production process in the refiner.

The fibers obtained are continuously coated in the blowline with the glue batch mentioned in Table 1.

COMPARATIVE EXAMPLE C3

An MDF board was produced analogously to the procedure described in example 1 but without addition of the compositions comprising bleach.

The achieved whiteness of examples 1a, 1 b and 1c, expressed by the lightness difference ΔL, based on comparative example C3 as standard is shown in Table 3.

TABLE 3

Bleach compositions 1a to 1c

| | Example | | | |
|---|---|---|---|---|
| | 1a | 1b | 1c | C3 |
| Hydrosulfite [% by weight] | 85 | 80 | 70 | — |
| Sodium sulfite [% by weight] | 7.5 | 12 | 13 | — |
| Sodium carbonate ($Na_2CO_3$) [% by weight] | 7.5 | 5 | 14 | — |
| Sodium tripolyphosphate [% by weight] | — | 3 | 1 | — |
| ΔL | 5.1 | 6.7 | 5.0 | — |

EXAMPLE 2

According to the Invention

Spruce woodchips were defibrated in the refiner, and a 15% strength by weight aqueous solution of the bleach composition mentioned under example 1b, corresponding to 5% by weight of bleach per absolutely dry fibers, was added. Thereafter, the fibers were coated in the blowline with the glue batch shown in Table 1. The glue-coated fibers were then pressed to give an MDF board.

COMPARATIVE EXAMPLE C4

An MDF board was produced analogously to the procedure described in example 2 but without the addition of a composition comprising bleach.

The whiteness achieved, expressed by the lightness difference ΔL, based on comparative example C4 as standard, is shown in Table 4.

TABLE 4

| Example | ΔL |
|---|---|
| 2 | 5.1 |
| C4 | — |

EXAMPLE 3

According to the Invention

A 15% strength by weight aqueous bleach composition according to example 1b, corresponding to 5% of bleach per absolutely dry fibers, was added to spruce and beech woodchips in the refiner. The fibers were coated continuously in the blowline with the glue batch shown in Table 5 and comprising the white pigment titanium dioxide, dried, and pressed together in MDF boards.

TABLE 5

| Glue batch | |
|---|---|
| Urea/melamine/formaldehyde resin, 66.5% strength by weight in water | 100.0 parts by weight |
| Paraffin dispersion, 60% strength by weight in water | 4.0 parts by weight |
| Titanium dioxide preparation, 70% strength by weight in water | 47.5 parts by weight |
| Solid resin content of the liquor | 44% |
| Solid resin/absolutely dry fibers | 14% |
| Liquor per 100 kg of absolutely dry fibers | 31.8 kg |

COMPARATIVE EXAMPLE C5

An MDF board was produced analogously to the procedure described in example 3 but without addition of the white pigment titanium dioxide. A glue batch according to Table 5 was used for coating with glue, the titanium dioxide preparation being replaced by the same amount of water.

The whiteness achieved, expressed by the lightness difference ΔL, based on comparative example C5 as standard, is shown in Table 6.

TABLE 6

| Example | ΔL |
|---|---|
| 3 | 4.7 |
| C5 | — |

EXAMPLE 4

According to the Invention

For the production of an MDF board, a 15% strength by weight aqueous bleach composition according to example 1b, corresponding to 5% of bleach per absolutely dry fibers, was added to beech woodchips in the refiner. In the blowline, the fibers obtained were coated continuously with the glue batch shown in Table 7. After drying, the glue-coated fibers were pressed to give MDF boards.

TABLE 7

| Glue batch | |
|---|---|
| Urea/melamine/formaldehyde resin, 66.5% strength by weight in water | 100.0 parts by weight |
| Paraffin dispersion, 60% strength by weight in water | 4.0 parts by weight |
| Water | 47.5 parts by weight |
| Solid resin content of the liquor | 44% |
| Solid resin/absolutely dry fibers | 14% |
| Liquor per 100 kg of absolutely dry fibers | 31.8 kg |

EXAMPLE 5

According to the Invention

An MDF board was produced analogously to the procedure described in example 4 but using the glue batch shown in Table 5 and comprising the white pigment titanium dioxide.

EXAMPLE 6

According to the Invention

An MDF board was produced analogously to the procedure described in example 5 but using the glue batch shown in Table 8 and comprising a combination of the white pigment titanium dioxide and optical brightener.

TABLE 8

| Glue batch | |
|---|---|
| Urea/melamine/formaldehyde resin, 66.5% strength by weight in water | 100.0 parts by weight |
| Paraffin dispersion, 60% strength by weight in water | 4.0 parts by weight |
| Titanium dioxide preparation, 50% strength by weight in water, comprising 2% by weight of a commercially available optical brightener | 47.5 parts by weight |
| Solid resin content of the liquor | 44% |
| Solid resin/absolutely dry fibers | 14% |
| Titanium dioxide/absolutely dry fibers | 5% |
| Optical brightener/absolutely dry fibers | 0.2% |
| Liquor per 100 kg of absolutely dry fibers | 31.8 kg |

COMPARATIVE EXAMPLE C6

An MDF board was produced analogously to the procedure described in example 4 but without the addition of the composition comprising bleach in the refiner.

The whitenesses achieved, expressed by the lightness difference ΔL, based on comparative example C6 as standard, are shown in Table 9.

TABLE 9

| Example | ΔL |
|---|---|
| 4 | 3.1 |
| 5 | 6.2 |
| 6 | 7.0 |
| C6 | — |

EXAMPLE 7

According to the Invention

Spruce woodchips were treated in the refiner with a 15% strength by weight aqueous solution of hydroxymethanesulfinic acid, corresponding to 5% of bleach per absolutely dry fibers. In the blowline, the bleached fibers were coated with the glue batch shown in Table 1.

COMPARATIVE EXAMPLE C7

An MDF board was produced analogously to the procedure described in example 7 but without addition of a solution comprising bleach.

The whiteness achieved, expressed by the lightness difference ΔL, based on comparative example C7 as standard, is shown in Table 10.

TABLE 10

| Example | ΔL |
|---|---|
| 8 | 5.2 |
| C7 | — |

EXAMPLE 8

According to the Invention

Poplar woodchips were treated with a 15% strength by weight aqueous bleach composition according to example 1b, corresponding to 5% of bleach per absolutely dry fibers during the MDF production process in the refiner. The fibers obtained were coated continuously in the blowline with the glue batch shown in Table 1.

COMPARATIVE EXAMPLE C8

An MDF board was produced analogously to the procedure described in example 8 but without addition of the composition comprising bleach.

The whiteness achieved, expressed by the lightness difference ΔL, based on comparative example C8 as standard, is shown in Table 11.

| Example | ΔL |
|---|---|
| 8 | 4.9 |
| C8 | — |

EXAMPLE 9

According to the Invention

Spruce chips were treated with a 15% strength by weight aqueous solution comprising bleach and according to example 1b, corresponding to 5% of bleach per absolutely dry fibers, during the MDF production process in the refiner. The fibers obtained were coated in the blowline with the glue batch shown in Table 1.

The glue-coated wood fibers were dried and were pressed to give a board. The board was then exposed for 24 hours in a Sun tester and the whiteness, expressed by the lightness difference ΔL, based on the unexposed board, was measured.

The results are shown in Table 12.

TABLE 12

| Example | ΔL |
|---|---|
| 9 exposed | −2 |
| 9 unexposed | — |

COMPARATIVE EXAMPLE C9

Spruce chips were treated with a 15% strength by weight aqueous hydrosulfite solution, corresponding to 5% of bleach per absolutely dry fibers, during the MDF production process in the refiner. The fibers obtained were coated continuously in the blowline with the glue batch shown in Table 1. The dried glue-coated wood fibers were pressed to give MDF boards.

Some of the boards were then exposed for 24 h in a Sun tester and the whiteness, expressed by the lightness difference ΔL, based on the exposed board, was measured.

The whiteness achieved is shown in Table 13.

| Example | ΔL |
|---|---|
| C9 exposed | −4.5 |
| C9 unexposed | — |

EXAMPLE 10

According to the Invention

A 15% strength by weight aqueous solution comprising bleach composition and according to example 1b, corresponding to 5% of bleach per absolutely dry fibers, was added to spruce woodchips during the MDF production process in the refiner. The fibers obtained were treated continuously in the blowline with the glue batch shown in Table 1.

COMPARATIVE EXAMPLE C10

An MDF board was produced analogously to the procedure described in example 4 but without the treatment of the wood fibers in the refiner with a bleach-containing composition.

The whiteness achieved, expressed by the lightness difference ΔL, transverse tensile strength, swelling and the odor of the boards determined by sensory methods, based in each case on comparative example C10 as standard, are shown in Table 14.

The transverse tensile strength of the MDF boards obtained was measured according to DIN 319, particle boards and fiber boards, determination of the tensile strength, perpendicular to the plane of the board.

The swelling was measured according to DIN EN 317, particle boards and fiber boards, determination of the thickness swelling and water absorption.

TABLE 14

| Example | ΔL | Transverse tensile strength [N/mm$^2$] | Swelling 24 h [%] | Odor |
|---|---|---|---|---|
| 10 | 6.3 | 0.85 | 6.67 | woody |
| C10 | — | 1.04 | 6.33 | woody |

We claim:

1. A process for the production of a bleached wood particle comprising a) milling an optionally pretreated, comminuted, cellulose-containing raw material in a refiner to obtain a wood particle and b) removing the wood particle from the refiner, wherein said wood particle is bleached in a) or in b) by the addition of a bleach composition consisting of i) from 60 to 95% by weight of one or more hydrosulfite salts, ii) from 1 to 25% by weight of one or more sulfite salts, iii) from 1 to 10% by weight of one or more basic salts selected from the group consisting of carbonates and bicarbonates, and iv) from 1 to 10% by weight of one or more tripolyphosphate salts.

2. The process according to claim 1, wherein the wood particle is removed via a blowline in b).

3. The process according to claim 1, wherein the comminuted, cellulose-containing raw material is pretreated in a digester before it is processed in a).

4. The process according to claim 1, wherein wood, bagasse or straw is used as the raw material for the wood particle.

5. A process for the production of a pale to white wood-base material, comprising a) and b) as described in claim 1 and c) processing the bleached wood particle to obtain a pale to white wood-base material.

6. The process according to claim 5, wherein b) is followed directly by c).

7. The process according to claim 5, wherein at least one white pigment is added during the production of the pale to white wood-base material.

8. The process according to claim 5, wherein at least one optical brightener is added during the production of the pale to white wood-base base material.

9. The process according to claim 5, wherein at least one white pigment and at least one optical brightener are added during the production of the pale to white wood-base base material.

10. The process according to claim 5, wherein the pale to white wood-base material is thereafter made into MDF boards, HDF boards, OSB boards or particle boards.

* * * * *